US006626801B2

(12) United States Patent
Marques

(10) Patent No.: US 6,626,801 B2
(45) Date of Patent: Sep. 30, 2003

(54) EXERCISE SYSTEM

(76) Inventor: Jean Pierre Marques, P.O. Box 180421, Coronado, CA (US) 92178-0421

( * ) Notice: Subject to any disclaimer, the term of this patent is extended or adjusted under 35 U.S.C. 154(b) by 140 days.

(21) Appl. No.: 09/800,128

(22) Filed: Mar. 5, 2001

(65) Prior Publication Data

US 2002/0123415 A1 Sep. 5, 2002

(51) Int. Cl.[7] ..... A63B 21/00
(52) U.S. Cl. ..... 482/23; 482/36; 482/35
(58) Field of Search ..... 482/35, 36, 37, 482/904, 148, 121, 83, 38, 39, 41, 42; 5/636, 624; 297/452.16

(56) References Cited

U.S. PATENT DOCUMENTS 3,874,657 A * 4/1975 Niebojewski ..... 482/904
4,927,135 A * 5/1990 Nieppola ..... 482/904
5,013,035 A * 5/1991 Nathaniel ..... 482/121
6,123,389 A * 9/2000 O'Conner et al. ..... 297/397

* cited by examiner

*Primary Examiner*—Jerome W. Donnelly

(57) ABSTRACT

An exercise system for providing a compact and complete exercise apparatus that strengthens, tones and corrects body alignment deficiency without the usage of weights. The exercise system includes a pair of elongate side members, a plurality of bar members extending between the side members, a plurality of eyelets attached to a front edge of the side members, and a mat member pivotally attached to a lower portion of the side members. A plurality of attachments can be attached to the bar members and the eyelets to allow the performance of various exercises such as a back member, a pull-up member, tricep members, and a strap.

18 Claims, 11 Drawing Sheets

EXERCISE SYSTEM

BACKGROUND OF THE INVENTION

1. Field of the Invention

The present invention relates generally to exercise devices and more specifically it relates to an exercise system for providing a combination of exercise disciplines within a single compact structure.

2. Description of the Prior Art

Exercise machines and apparatuses have been in use for years. Typically, exercise machines only provide for one type of work out such as treadmills, stationary bicycles, stair machines and various other well-known exercise machines. Very few of these machines provide the versatility to combine various styles and disciplines of workouts into a single compact structure. In addition, purchasing these various types of conventional exercise devices can be extremely expensive and require a significant amount of space to utilize and store.

Examples of patented exercise devices which are illustrative of such prior art include U.S. Pat. No. 5,626,546 to Little; U.S. Pat. No. 5,586,962 to Hallmark; U.S. Pat. No. 5,013,035 to Nathaniel; U.S. Pat. No. 232,579 to Weeks; U.S. Pat. No. 3,618,942 to Bates et al; U.S. Pat. No. 6,015,371 to Davitt; U.S. Pat. No. 5,496,246 to Pierre; U.S. Pat. No. 5,123,886 to Cook; U.S. Pat. No. 254,108 to Bryon; U.S. Pat. No. 5,688,210 to Chou; U.S. Pat. No. 5,277,683 to Wilkins.

While these devices may be suitable for the particular purpose to which they address, they are not as suitable for providing a compact and complete exercise apparatus that strengthens, tones and corrects body alignment deficiency without the usage of weights. Conventional exercise devices and equipment are bulky, expensive and require a significant amount of space to utilize.

In these respects, the exercise system according to the present invention substantially departs from the conventional concepts and designs of the prior art, and in so doing provides an apparatus primarily developed for the purpose of providing a compact and complete exercise apparatus that strengthens, tones and corrects body alignment deficiency without the usage of weights.

SUMMARY OF THE INVENTION

In view of the foregoing disadvantages inherent in the known types of exercise devices now present in the prior art, the present invention provides a new exercise system construction wherein the same can be utilized for providing a compact and complete exercise apparatus that strengthens, tones and corrects body alignment deficiency without the usage of weights.

The general purpose of the present invention, which will be described subsequently in greater detail, is to provide a new exercise system that has many of the advantages of the exercise devices mentioned heretofore and many novel features that result in a new exercise system which is not anticipated, rendered obvious, suggested, or even implied by any of the prior art exercise devices, either alone or in any combination thereof.

To attain this, the present invention generally comprises a pair of elongate side members, a plurality of bar members extending between the side members, a plurality of eyelets attached to a front edge of the side members, and a mat member pivotally attached to a lower portion of the side members. A plurality of attachments can be attached to the bar members and the eyelets to allow the performance of various exercises such as a back member, a pull-up member, tricep members, and a strap.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an exercise system that will overcome the shortcomings of the prior art devices.

A second object is to provide an exercise system for providing a compact and complete exercise apparatus that strengthens, increases flexibility, improves cardiovascular, reduces stress, restores, vitality, tones and corrects body alignment deficiency without the usage of weights.

Another object is to provide an exercise system that provides a simple, complete and safe workout.

An additional object is to provide an exercise system that assists in reeducating skeletal imbalance and muscle weakness.

A further object is to provide an exercise system that has no moving mechanical components.

Another object is to provide an exercise system that can be utilized for both exercising and physical therapy.

An additional object is to provide an exercise system that is affordable and requires a minimum amount of space.

A further object is to provide an exercise system that can be utilized within a gym or within a home.

Another object is to provide an exercise system that assists in reducing stress to joints and reducing injuries during exercises.

An additional object is to provide an exercise system that incorporates yoga postures, ballet, martial arts and resistance training with reduced stress to the joints.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
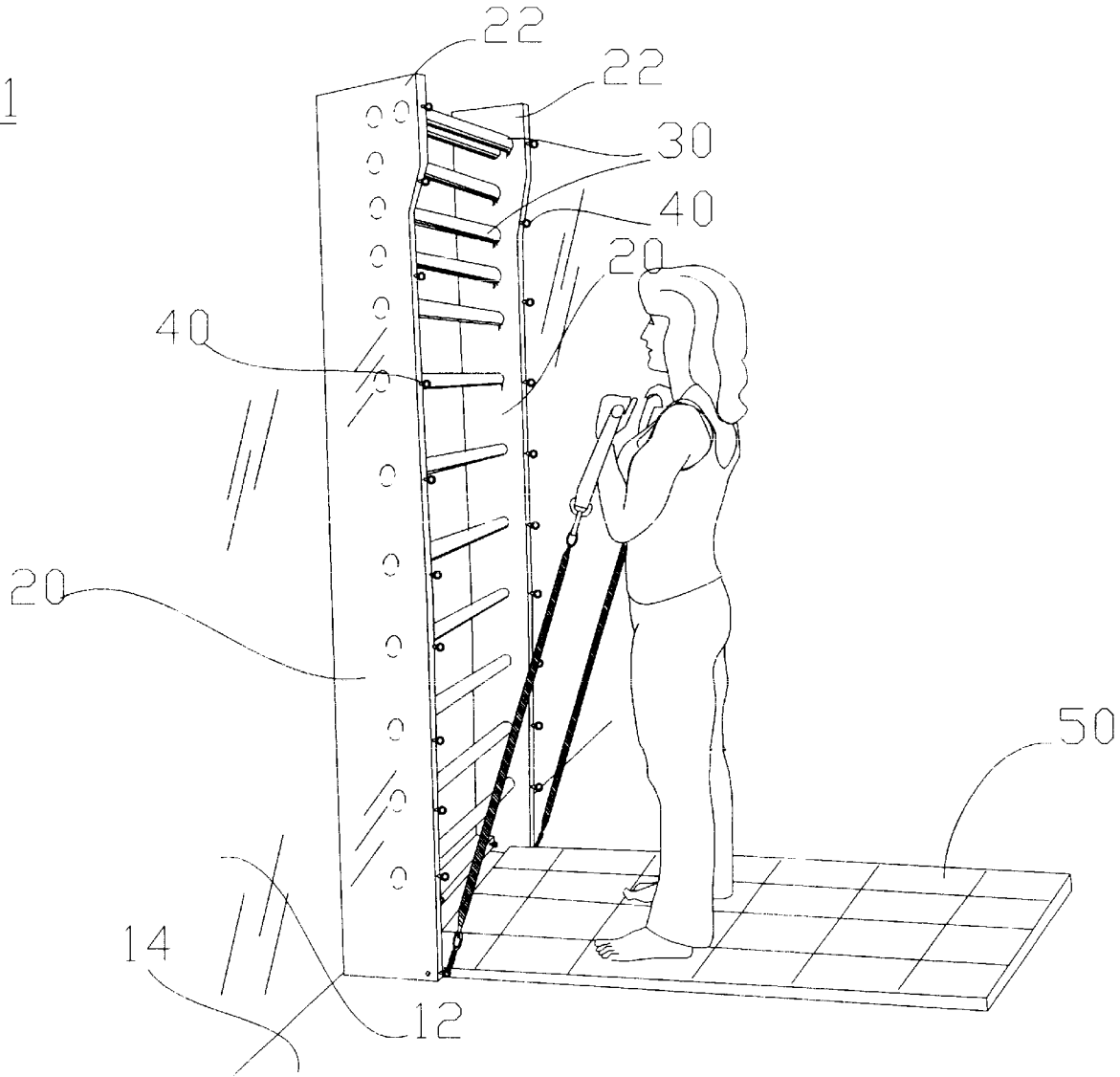
FIG. 1 is an upper perspective view of the present invention.

Turning now descriptively to the drawings, in which similar reference characters denote similar elements throughout the several views, FIGS. 1 through 11 illustrate an exercise system 10, which comprises a pair of elongate side members 20, a plurality of bar members 30 extending between the side members 20, a plurality of eyelets 40 attached to a front edge of the side members 20, and a mat member 50 pivotally attached to a lower portion of the side members 20. A plurality of attachments can be attached to the bar members 30 and the eyelets 40 to allow the performance of various exercises such as a back member 70, a pull-up member 72, tricep members 74, and a strap 60.

As shown in FIGS. 1 through 3 and 5 of the drawings, a pair of elongate side members 20 extend a finite distance upwardly from the floor 14 adjacent the wall 12. The side members 20 may be comprised of any structure, shape and material as can be appreciated. The side members 20 preferably have a consistent depth from the bottom toward an upper portion of the side members 20.

Figure 3:
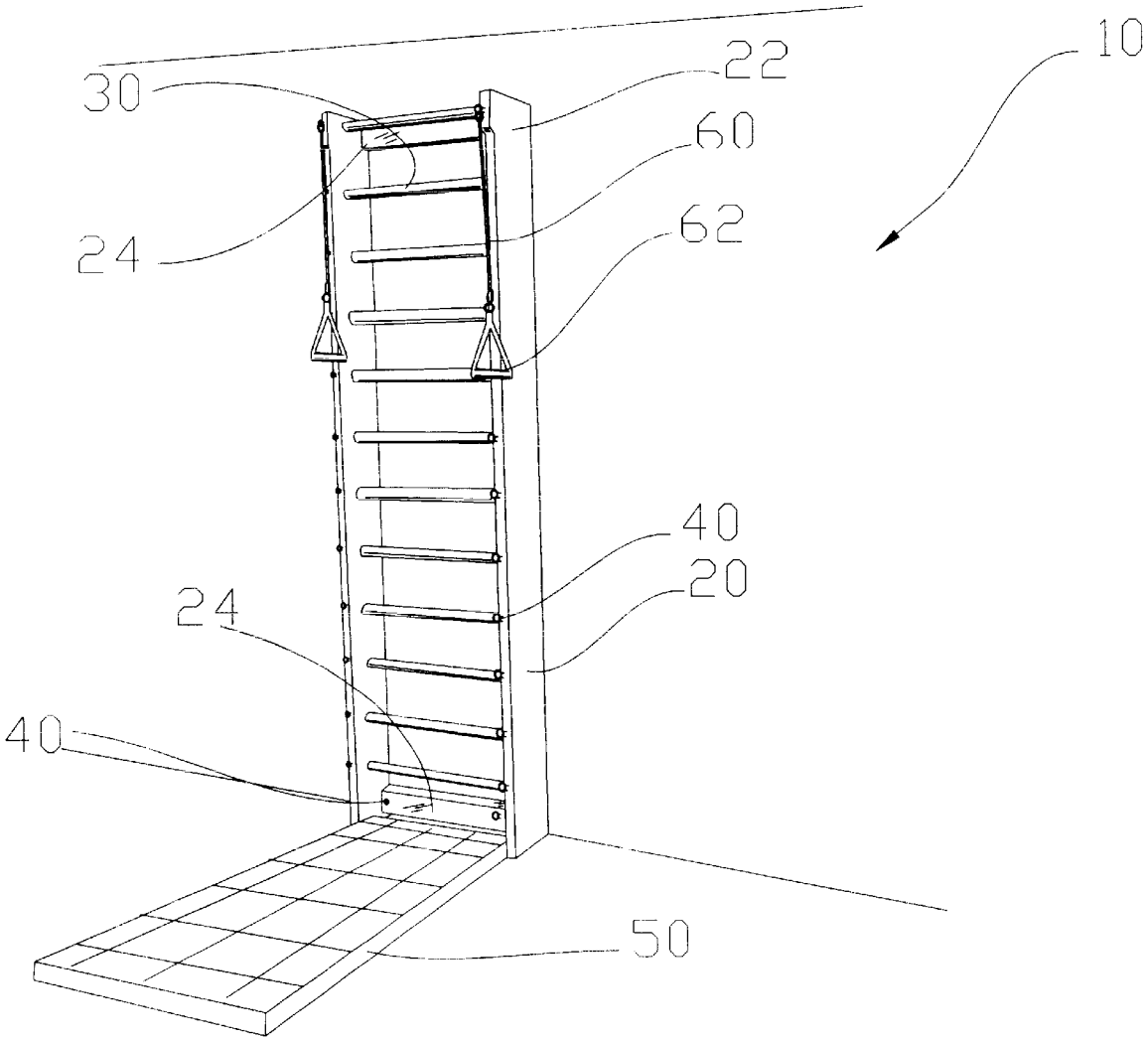
FIG. 3 is an upper perspective view of the present invention with the mat member within the extended position.
Figure 4:
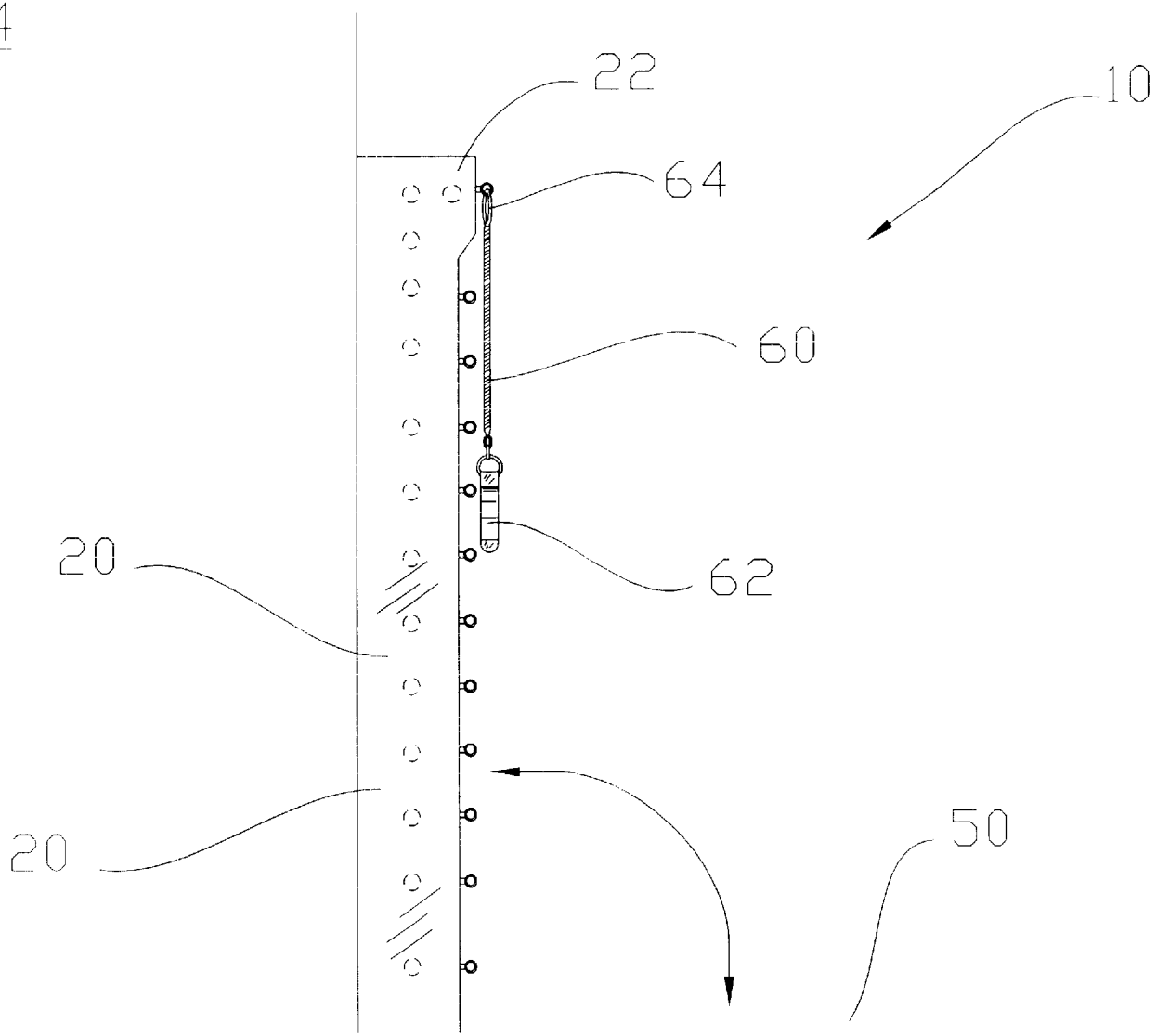
FIG. 4 is a side view of the present invention showing the mat member in the extended position.
Figure 5:
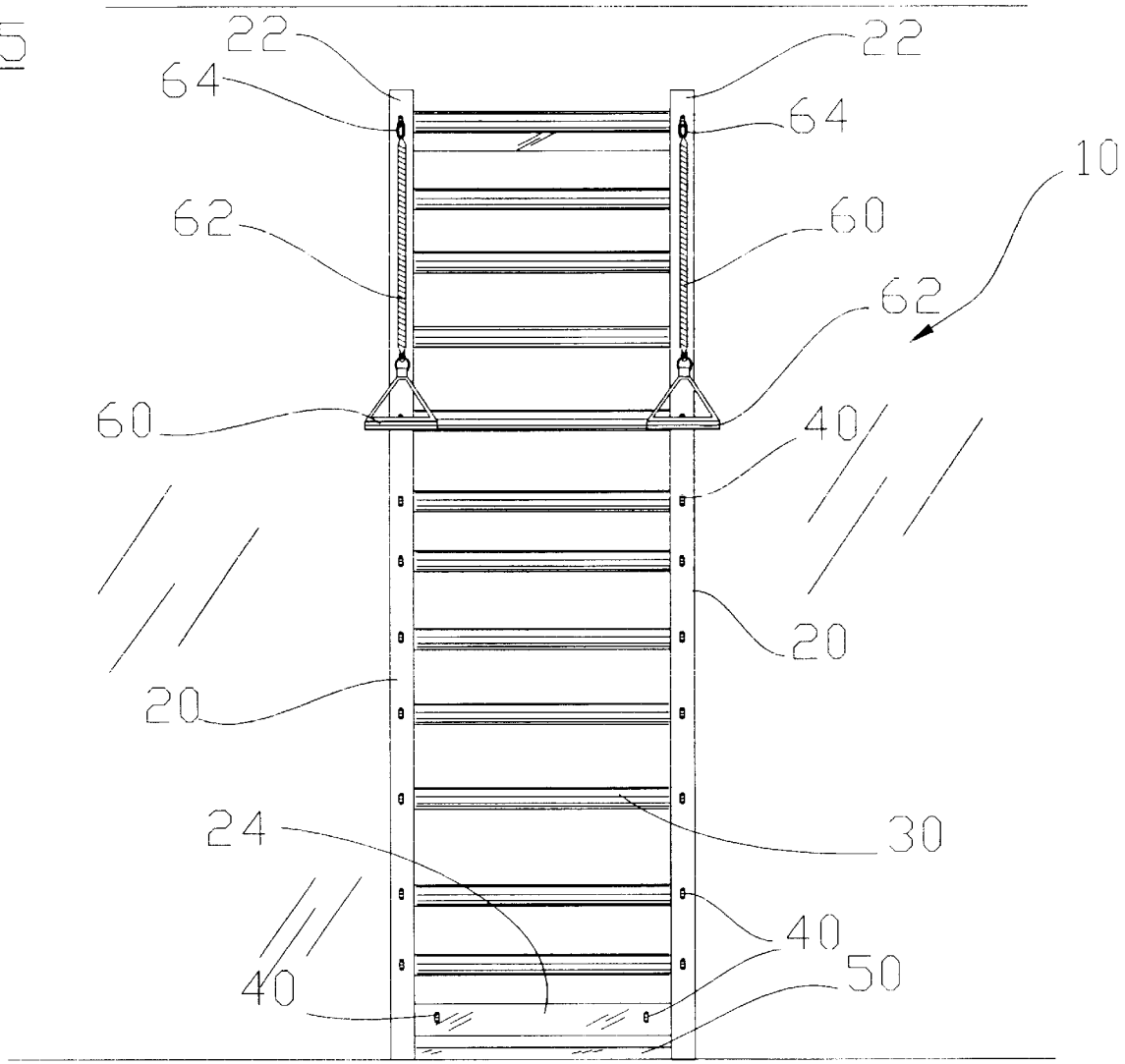
FIG. 5 is a front view of the present invention with the mat member in the extended position.
Figure 6:
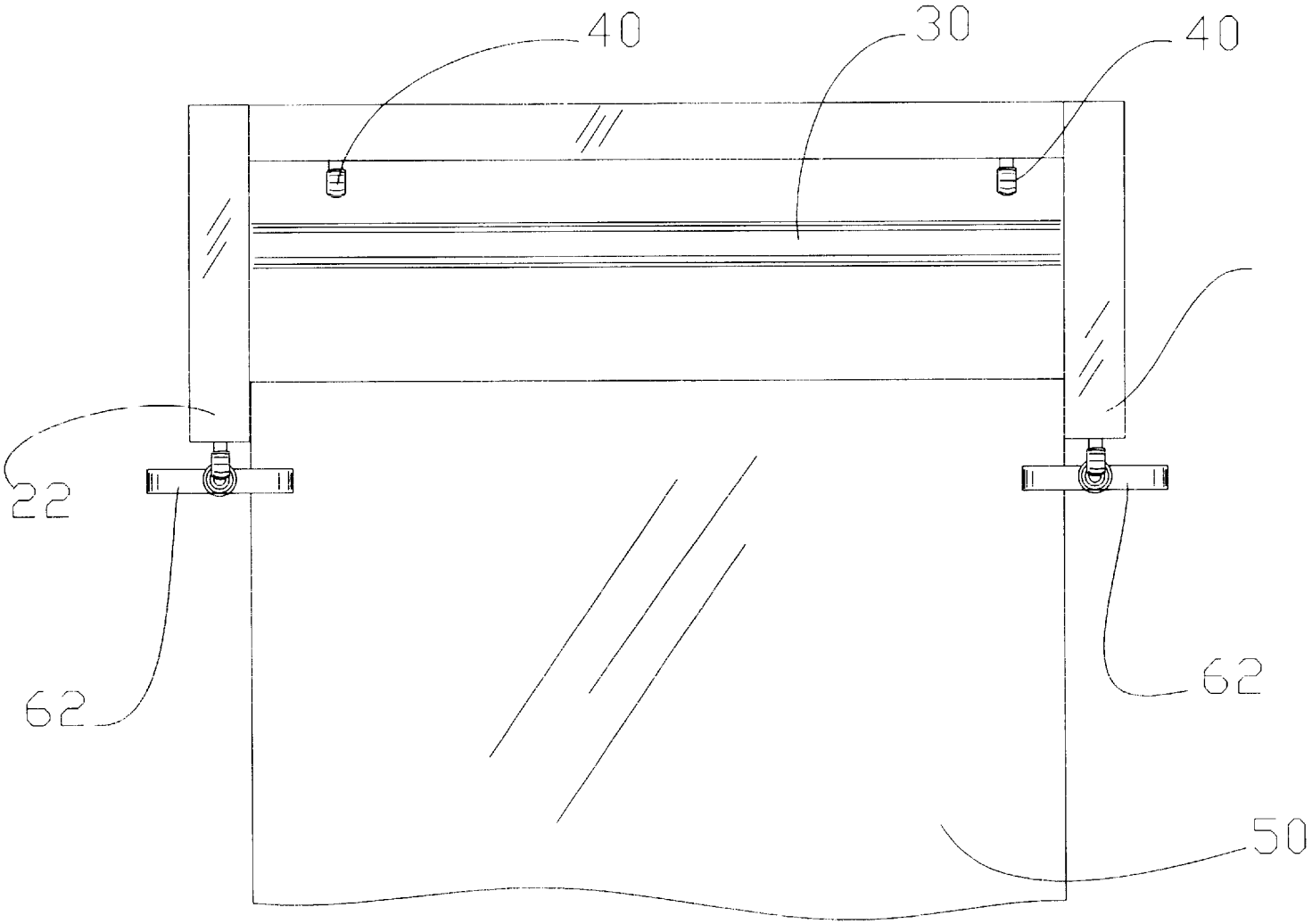
FIG. 6 is a top view of the present invention.

The side members 20 preferably include an extended portion 22 as shown in FIGS. 3 and 4 of the drawings. As shown in FIGS. 3 and 5 of the drawings, at least two brace members 24 extended between the side members 20 for providing support to the side members 20. The side members 20 and brace members 24 may be attached to the wall 12 via any well-known attachment means such as fasteners, nails, screws, and brackets.

As best shown in FIGS. 1, 3 and 5 of the drawings, a plurality of bar members 30 extend between the side members 20. The bar members 30 preferably are distally spaced apart an equal distance as shown in FIG. 5 of the drawings, however it can be appreciated that the bar members 30 may have varying distances between thereof. As best shown in FIG. 1 of the drawings, at least one of the bar members 30 is secured outwardly between the extended portion 22 of the side members 20. The bar members 30 may be constructed of any type of material including tubular and solid materials. The bar members 30 may also have any well-known shape and structure.

As shown in FIGS. 1 through 5 of the drawings, a plurality of eyelets 40 are attached to the front edge of each of the side members 20 and to at least one of the bar members 30. The eyelets 40 are capable of receiving one or more couplers 64 from various types of auxiliary equipment. The eyelets 40 are preferably distally spaced an equal distance apart as shown in FIGS. 1 through 5 of the drawings. In addition, the eyelets 40 preferably are aligned in pairs that are adjacent opposing ends of each of the bar members 30 as best shown in FIG. 5 of the drawings.

Figure 2:
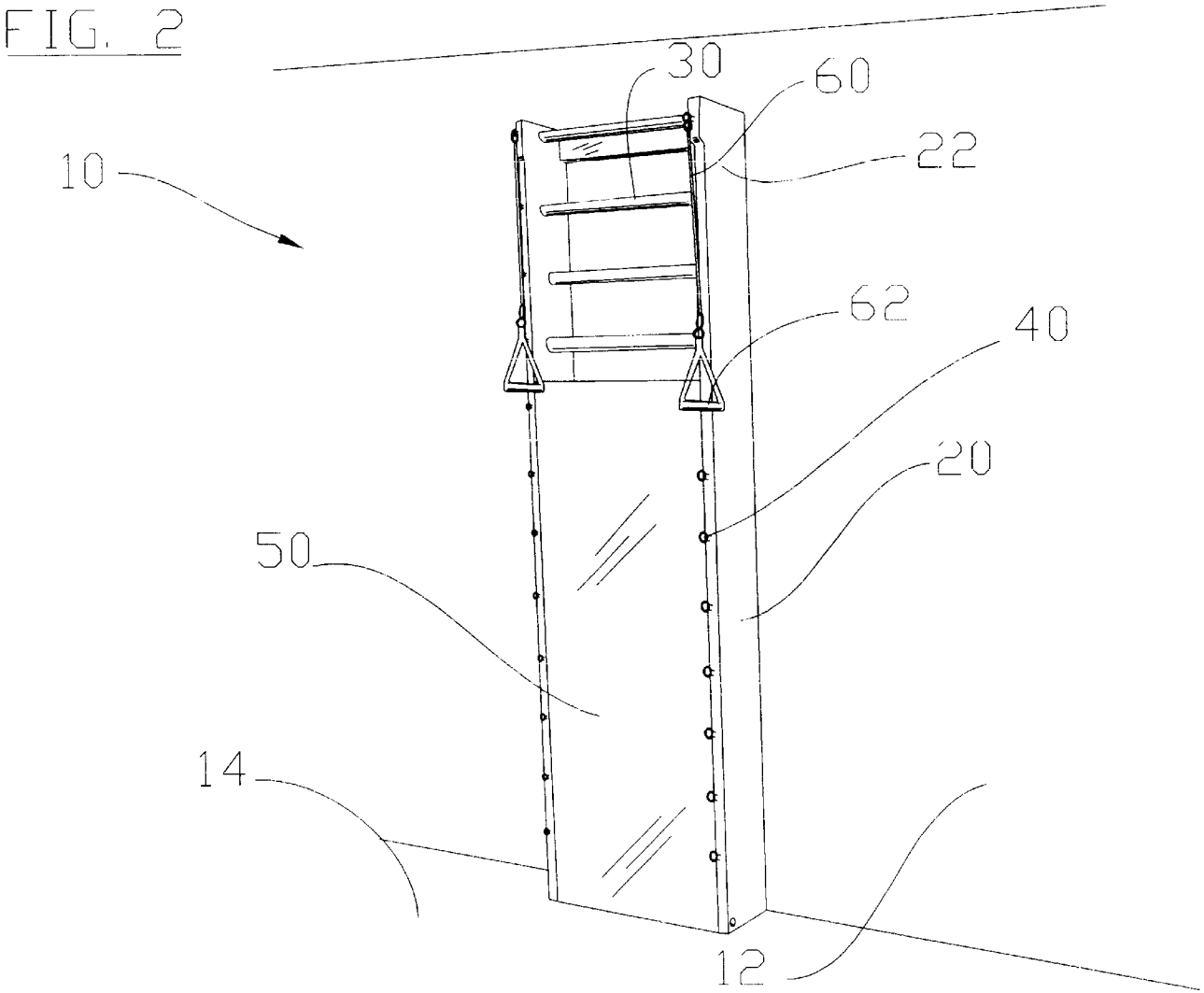
FIG. 2 is an upper perspective view of the present invention with the mat member within the storage position.

As shown in FIGS. 1 through 4 of the drawings, a mat member 50 is pivotally attached between the lower portion of the side members 20. The mat member 50 may be comprised of any structure and material. The mat member 50 preferably has a rigid characteristic allowing it to be folded upwardly into a compact storage position as shown in FIG. 2 of the drawings. The mat member 50 may also include various types of lines and indicia for assisting an individual in proper body positioning during an exercise.

Figure 7:
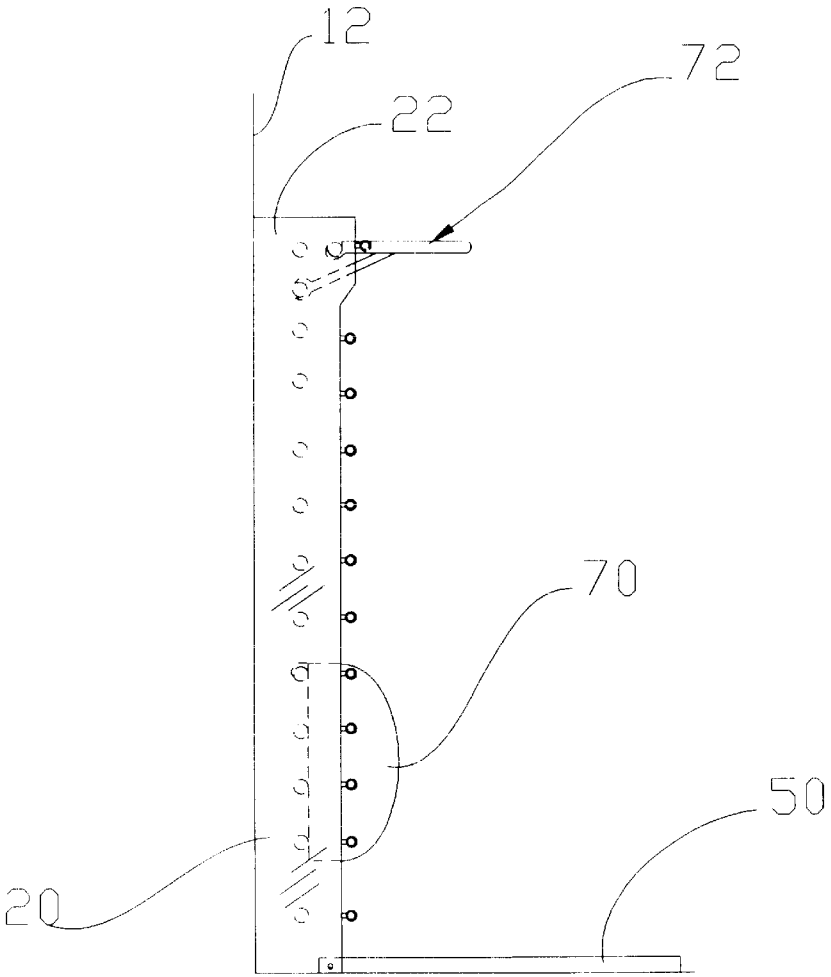
FIG. 7 is a side view of the present invention with the pull-up member and the back member attached thereto.
Figure 8:
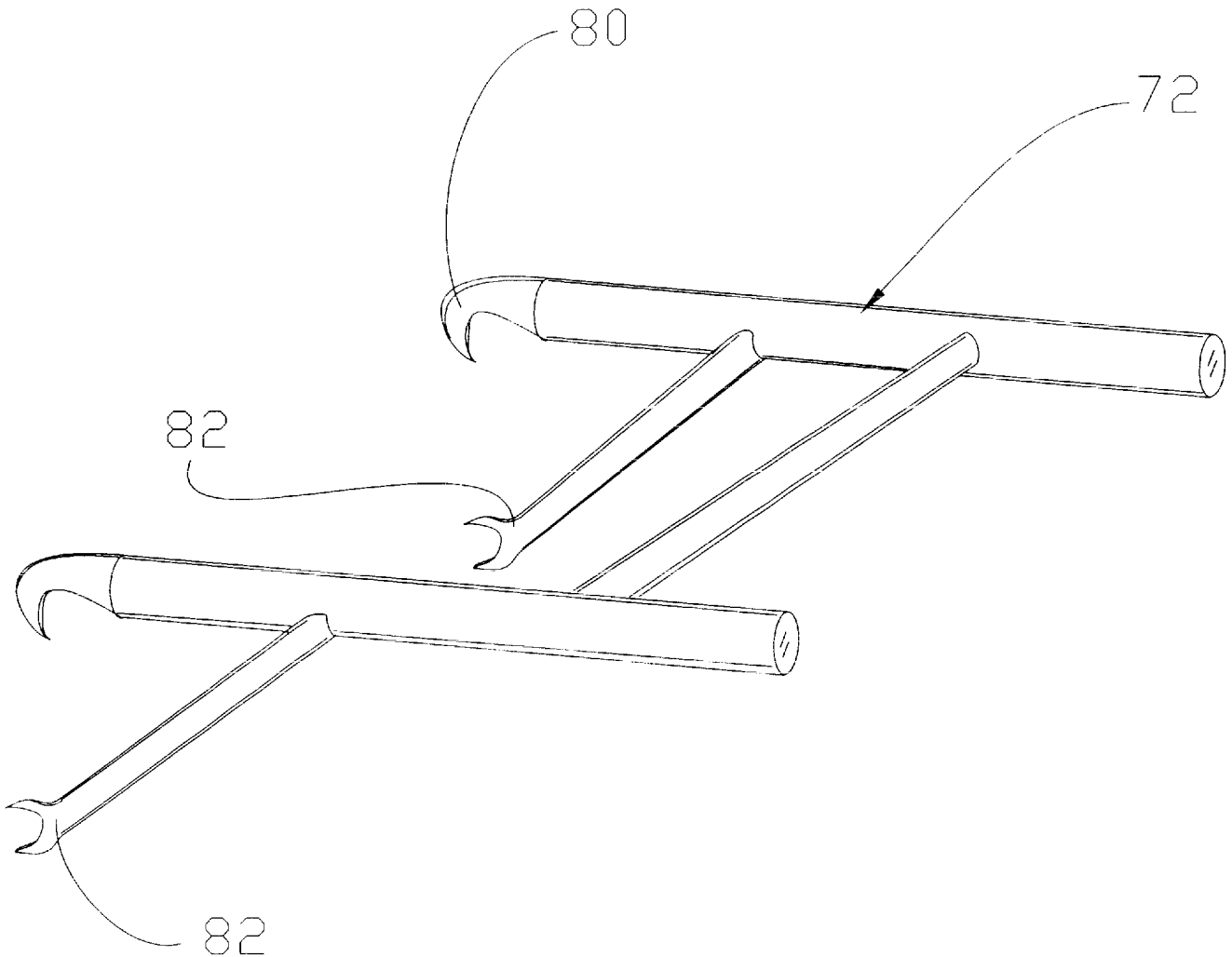
FIG. 8 is an upper perspective view of the pull-up member.
Figure 9:
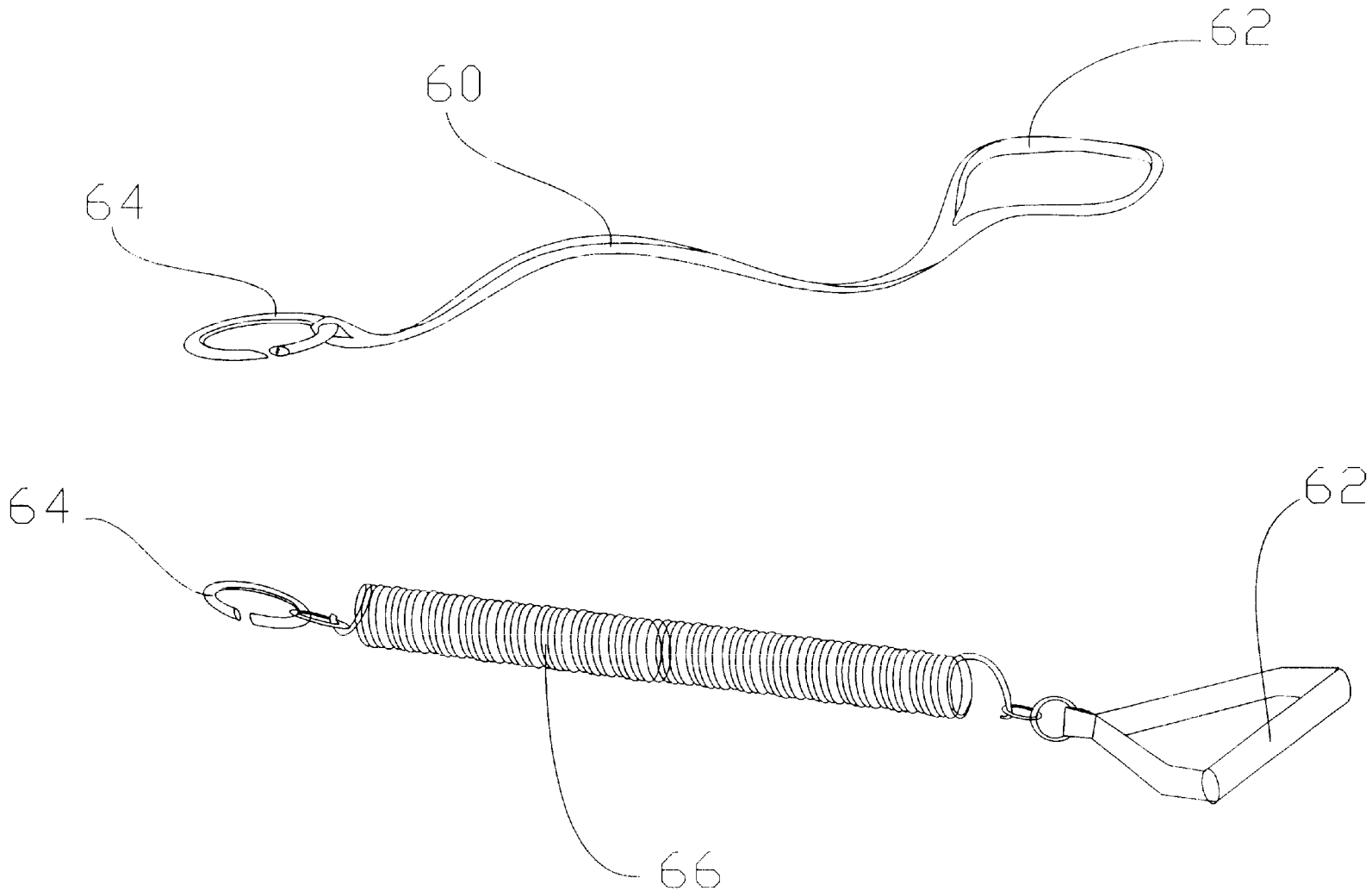
FIG. 9 is an upper perspective view of the strap and the coil spring structures.
Figure 10:
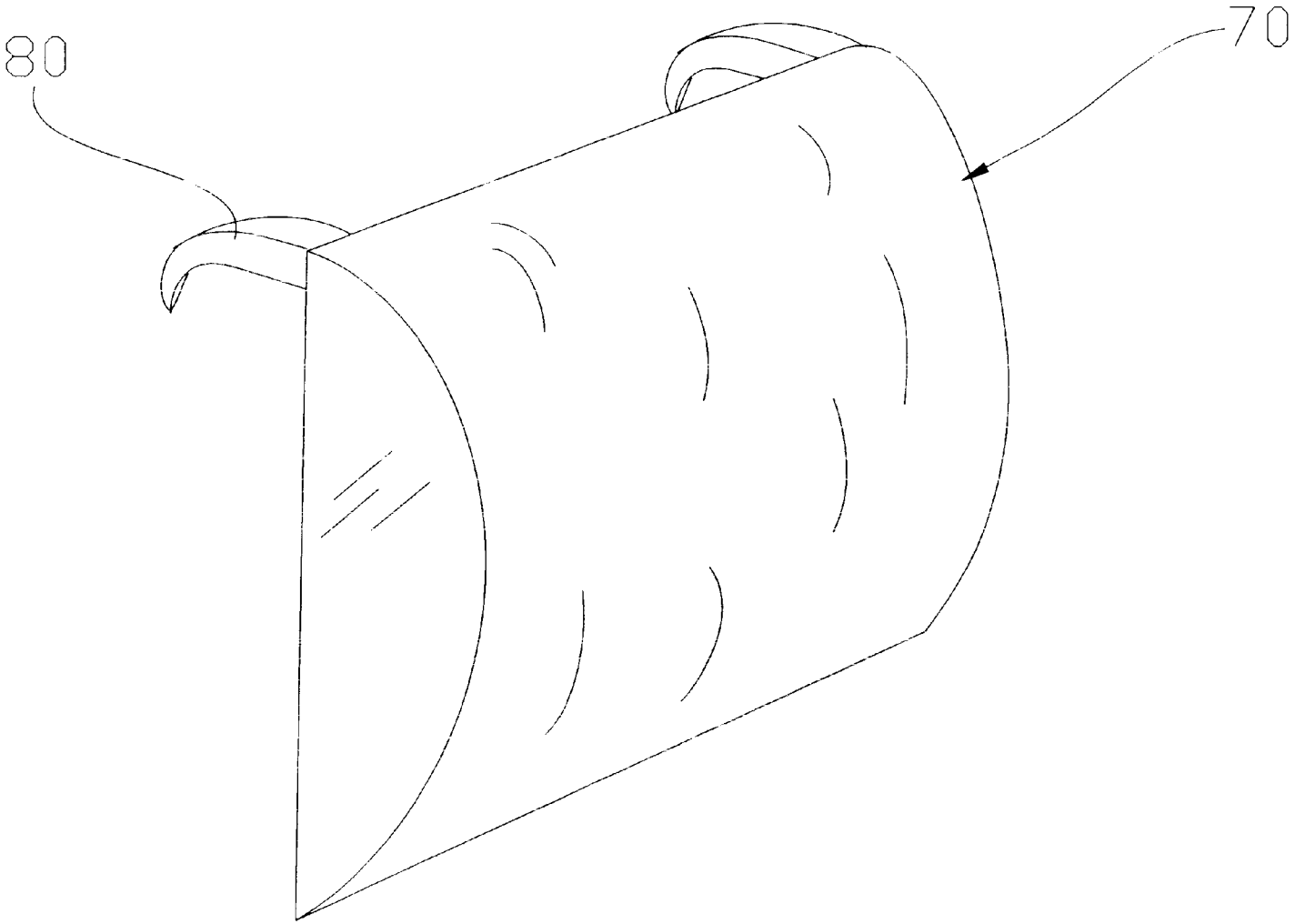
FIG. 10 is an upper perspective of the back member.
Figure 11:
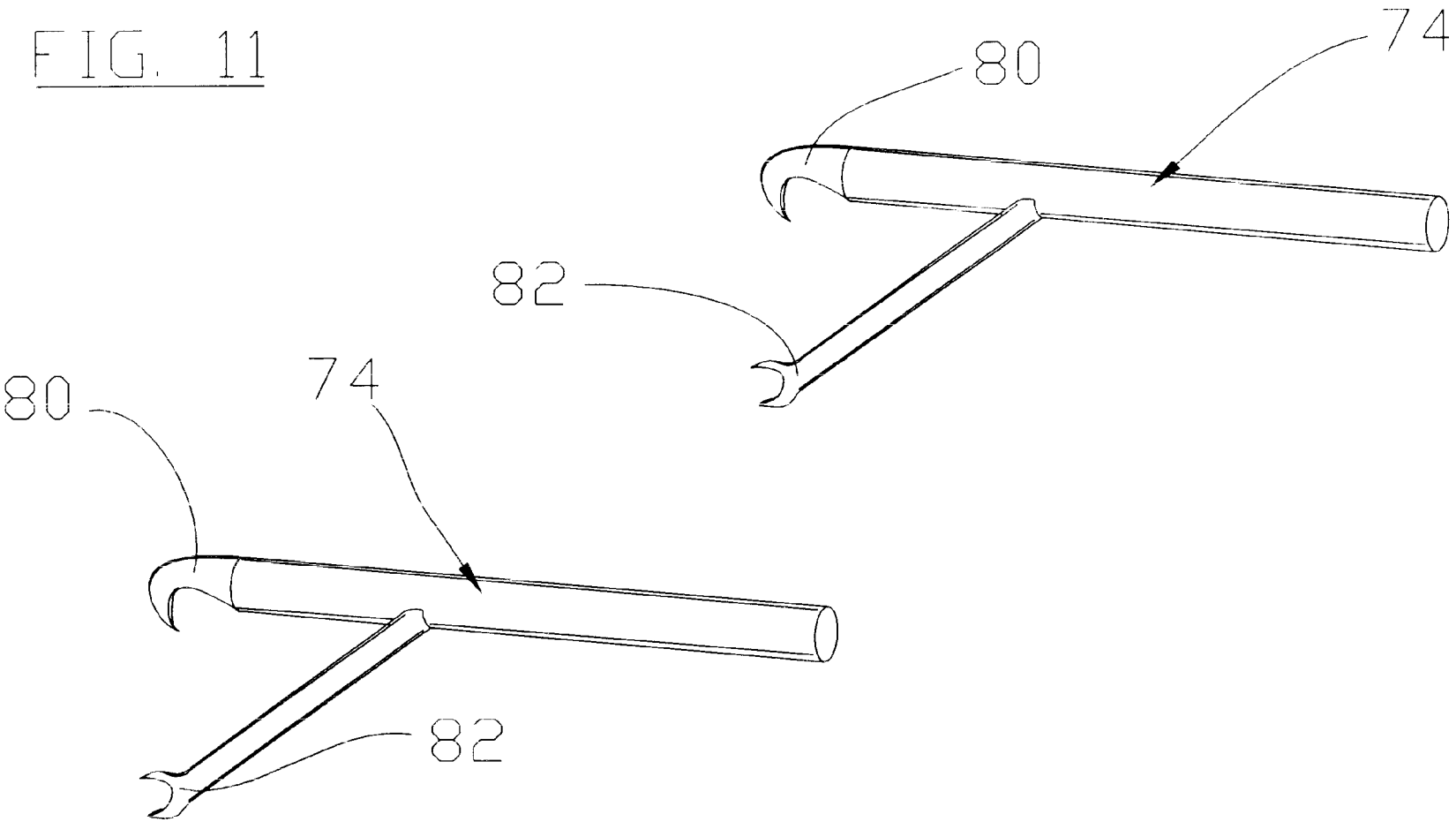
FIG. 11 is an upper perspective view of the tricep members.

As shown in FIGS. 7 through 11 of the drawings, a plurality of auxiliary attachments may be utilized in conjunction with the previously stated portion of the exercise system 10. At least one elongated strap 60 or coil spring 66 includes a coupler 64 and a handle 62 on opposing ends thereof as shown in FIG. 9 of the drawings. The coupler 64 is attachable to the various heights of eyelets 40 as shown in FIGS. 1 through 5 of the drawings. A back member 70 having a curved surface and at least one hook 80 is attachable at various heights upon the bar members 30 as shown in FIGS. 7 and 10 of the drawings. As shown in FIG. 8 of the drawings, a pull-up member 72 is provided having a pair of hooks 80 for engaging the bar members 30 and a pair of angled support members each having a claw 82 for engaging a lower one of the bar members 30. As shown in FIG. 11 of the drawings, a pair of tricep members 74 are provided each having a hook 80 and a lower angled support member having a claw 82 attachable to the bar members 30.

In use, the user manipulates the mat member 50 into the lower position as shown in FIGS. 1, 3 and 4 of the drawings. The user may utilize the bar members 30 to stretch their arms, legs and body at various heights and positions. The user may also attach any of the various auxiliary attachments to the exercise system. For example, the user may attach the back member 70 to one of the bar members 30 at the desired height thereby allowing them to stretch their back over the curved surface of the back member 70 as shown in FIG. 7 of the drawings. The user may also attach one or more straps 60 to the eyelets 40 for performing various exercises as shown in FIGS. 1 through 5 of the drawings. The user may also attach the pull-up member 72 to the bar members 30 as shown in FIG. 7 of the drawings thereby allowing them to perform a series of pull-up exercises. The tricep members 74 are similarly attached to the bar members 30 for allowing the performance of tricep exercises. When finished utilizing the exercise system, the user then manipulates the mat member 50 into the upright storage position as shown in FIG. 2 of the drawings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise system, comprising:

a pair of elongate side members having an upper portion including an extended portion;

a plurality of bar members attached between said pair of elongate side members said plurality of bar members including an upper bar member that extends outwardly from a rear portion of said pair of side members;

a plurality of eyelets attached to a front edge of each of said pair of elongate side members; and a mat member pivotally attached to and between lower ends of said pair of elongate side members for allowing said mat member to be positioned in an extended position and a storage position, wherein said extended position is comprised of said mat member substantially flush with a floor structure in a horizontal manner and wherein said storage position is comprised of said mat member substantially vertical between said pair of elongate side members.

2. The exercise system of claim 1, including at least one strap having a coupler and a handle attached to opposing ends, wherein said coupler is attachable to said plurality of eyelets.

3. The exercise system of claim 2, wherein said strap is stretchable.

4. The exercise system of claim 3, wherein said strap is comprised of a coil spring.

5. The exercise system of claim 1, including a pull-up member having a pair of hooks and a pair of angled members with a corresponding pair of claws, wherein said hooks and said claws are formed to engage said plurality of bar members.

6. The exercise system of claim 1, including a back member having a front curved surface and at least one hook for engaging the bar members.

7. The exercise system of claim 1, including a pair of tricep members each having a hook and an angled member with a corresponding claw for engaging the bar members.

8. The exercise system of claim 1, wherein said bar members are distally spaced upon the pair of said members an equal distance.

9. The exercise system of claim 1, wherein said pair of side members have corresponding widths.

10. An exercise system, comprising:

a pair of elongate side members; having an upper portion including an extend portion; extending parallel with respect to one another in a vertical manner;

a plurality of bar members attached to and between said pair of elongate side members said plurality of bar members including an upper bar members that extends outwardly from a rear portion of said pair of side members, in a horizontal manner;

a plurality of eyelets attached in a vertical manner to a front edge of each of said pair of elongate side members; and a mat member pivotally attached between lower ends of said pair of elongate side members for allowing said mat member to be positioned in an extended position and a storage position, wherein said extended position is comprised of said mat member substantially flush with a floor structure in a horizontal manner and wherein said storage position is comprised of said mat member substantially vertical between said pair of elongate side members.

11. The exercise system of claim 10, wherein an upper portion of said pair of elongate side members include an extended portion.

12. The exercise system of claim 10, including at least one strap having a coupler and a handle attached to opposing ends, wherein said coupler is attachable to said plurality of eyelets.

13. The exercise system of claim 12, wherein said strap is stretchable.

14. The exercise system of claim 13, wherein said strap is comprised of a coil spring.

15. The exercise system of claim 10, including a pull-up member having a pair of hooks and a pair of angled members with a corresponding pair of claws, wherein said hooks and said claws are formed to engage said plurality of bar members.

16. The exercise system of claim 10, including a back member having a front curved surface and at least one hook for engaging the bar members.

17. The exercise system of claim 10, including a pair of tricep members each having a hook and an angled member with a corresponding claw for engaging the bar members.

18. The exercise system of claim 10, wherein said bar members are distally spaced upon the pair of side members an equal distance.

* * * * *